US009707143B2

(12) United States Patent
Thodupunuri et al.

(10) Patent No.: US 9,707,143 B2
(45) Date of Patent: Jul. 18, 2017

(54) PERSON SUPPORT APPARATUS POWER DRIVE SYSTEM

(71) Applicant: Hill-Rom Services, Inc., Batesville, IN (US)

(72) Inventors: Mahesh Kumar Thodupunuri, Batesville, IN (US); Brian Guthrie, Greensburg, IN (US); John G. Byers, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/795,404

(22) Filed: Mar. 12, 2013

(65) Prior Publication Data

US 2014/0041119 A1 Feb. 13, 2014

Related U.S. Application Data

(60) Provisional application No. 61/682,203, filed on Aug. 11, 2012, provisional application No. 61/682,202, filed on Aug. 11, 2012.

(51) Int. Cl.

*A61G 7/08* (2006.01)
*A61G 7/012* (2006.01)
(Continued)

(52) U.S. Cl.

CPC ..... *A61G 7/08* (2013.01); *A61G 7/012* (2013.01); *A61G 7/018* (2013.01); *A61G 7/0524* (2016.11); *A61G 7/0527* (2016.11); *A61G 2203/40* (2013.01); *A61G 2203/42* (2013.01); *A61G 2203/44* (2013.01); *A61G 2203/726* (2013.01)

(58) Field of Classification Search

CPC .. A61G 7/08; A61G 2007/0528; A61G 7/018; A61G 1/0237; A61G 1/0268

USPC ..... 5/510, 424, 86.1, 611; 177/144; 180/15, 180/16, 19.1–19.3

See application file for complete search history.

(56) References Cited

U.S. PATENT DOCUMENTS 813,213 A 2/1906 Johnson
1,110,838 A 9/1914 Taylor
(Continued)

FOREIGN PATENT DOCUMENTS

CA 2010543 9/1990
CA 2294761 1/1999
(Continued)

OTHER PUBLICATIONS

European Search Report for EP 16 17 5338, dated Sep. 19, 2016, 9 pages.

(Continued)

*Primary Examiner* — Robert G Santos
*Assistant Examiner* — Myles Throop
(74) *Attorney, Agent, or Firm* — Barnes & Thornburg LLP

(57) ABSTRACT

A person support apparatus comprises a lower frame, an upper frame, a drive structure, and a control system. The upper frame is movably supported above the lower frame. The drive structure is coupled to the upper frame and configured to selectively engage a surface to, when activated, propel the person support apparatus along the surface. The control system is configured to determine an engagement status of the drive structure with the surface and trigger a response based on the engagement status.

27 Claims, 9 Drawing Sheets

(51) Int. Cl.
*A61G 7/018* (2006.01)
*A61G 7/05* (2006.01)

(56) References Cited

U.S. PATENT DOCUMENTS 1,118,931 A 12/1914 Hasley
1,598,124 A 8/1926 Evans
1,639,801 A 8/1927 Heise
1,778,698 A 10/1930 Walter
2,224,087 A 12/1940 Reichert
2,599,717 A 6/1952 Menzies
2,635,899 A 4/1953 Osbon, Jr.
2,999,555 A 9/1961 Stroud et al.
3,004,768 A 10/1961 Klages
3,112,001 A 11/1963 Wise
3,304,116 A 2/1967 Stryker
3,305,876 A 2/1967 Hutt
3,380,546 A 4/1968 Rabjohn
3,393,004 A 7/1968 Williams
3,404,746 A 10/1968 Slay
3,452,371 A 7/1969 Hirsch
3,544,127 A 12/1970 Dobson
3,618,966 A 11/1971 Vandervest
3,680,880 A 8/1972 Blaauw
3,770,070 A 11/1973 Smith
3,802,524 A 4/1974 Seidel
3,814,199 A 6/1974 Jones
3,820,838 A 6/1974 Limpach
3,869,011 A 3/1975 Jensen
3,872,945 A 3/1975 Hickman et al.
3,876,024 A 4/1975 Shieman et al.
3,938,608 A 2/1976 Folco-Zambelli
4,137,984 A 2/1979 Jennings et al.
4,164,355 A 8/1979 Eaton et al.
4,167,221 A 9/1979 Edmonson et al.
4,175,632 A 11/1979 Lassanske
4,175,783 A 11/1979 Pioth
4,221,273 A 9/1980 Finden
4,274,503 A 6/1981 Mackintosh
4,275,797 A 6/1981 Johnson
4,415,049 A 11/1983 Wereb
4,415,050 A 11/1983 Nishida et al.
4,439,879 A 4/1984 Werner
4,444,284 A 4/1984 Montemurro
4,475,611 A 10/1984 Fisher
4,475,613 A 10/1984 Walker
4,511,825 A 4/1985 Klimo
4,513,832 A 4/1985 Engman
4,566,707 A 1/1986 Nitzberg
4,584,989 A 4/1986 Stith
4,614,246 A 9/1986 Masse et al.
4,629,242 A 12/1986 Schrager
4,646,860 A 3/1987 Owens et al.
4,723,808 A 2/1988 Hines
4,724,555 A 2/1988 Poehner et al.
4,759,418 A 7/1988 Goldenfeld et al.
4,771,840 A 9/1988 Keller
4,807,716 A 2/1989 Hawkins
4,811,988 A 3/1989 Immel
4,848,504 A 7/1989 Olson
4,874,055 A 10/1989 Beer
4,895,040 A 1/1990 Soederberg
4,922,574 A 5/1990 Heiligenthal et al.
4,938,493 A 7/1990 Okuda
4,949,408 A 8/1990 Trkla
4,979,582 A 12/1990 Forster
4,981,309 A 1/1991 Froeschle et al.
5,039,119 A 8/1991 Baughman
5,060,327 A 10/1991 Celestina et al.
5,060,959 A 10/1991 Davis et al.
5,069,465 A 12/1991 Stryker et al.
5,083,625 A * 1/1992 Bleicher ..... 180/65.1
5,084,922 A 2/1992 Louit
5,094,314 A 3/1992 Hayata
5,117,521 A 6/1992 Foster et al.
5,121,806 A 6/1992 Johnson
5,156,226 A 10/1992 Boyer et al.
5,181,762 A 1/1993 Beumer
5,187,824 A 2/1993 Stryker
5,193,633 A 3/1993 Ezenwa
5,201,819 A 4/1993 Shiraishi et al.
5,222,567 A 6/1993 Broadhead et al.
5,232,065 A 8/1993 Cotton
5,244,225 A 9/1993 Frycek
5,251,429 A 10/1993 Minato et al.
5,255,403 A 10/1993 Ortiz
5,279,010 A 1/1994 Ferrand et al.
5,284,218 A 2/1994 Rusher, Jr.
5,293,950 A 3/1994 Marliac
5,307,889 A 5/1994 Bohannan
5,322,306 A 6/1994 Coleman
5,337,845 A 8/1994 Foster et al.
5,348,326 A 9/1994 Fullenkamp et al.
5,358,265 A 10/1994 Yaple
5,366,036 A 11/1994 Perry
5,381,572 A 1/1995 Park
5,388,294 A 2/1995 Reeder
5,406,778 A 4/1995 Lamb et al.
5,439,069 A 8/1995 Beeler
5,445,233 A 8/1995 Fernie et al.
5,447,317 A 9/1995 Gehlsen et al.
5,447,935 A 9/1995 Hubele et al.
5,450,639 A 9/1995 Weismiller et al.
5,477,935 A 12/1995 Chen
5,487,437 A 1/1996 Avitan
5,495,904 A 3/1996 Zwaan et al.
5,526,890 A 6/1996 Kadowaki
5,531,030 A 7/1996 Dale, Jr.
5,535,465 A 7/1996 Hannant
5,542,690 A 8/1996 Kozicki
5,562,091 A 10/1996 Foster et al.
5,570,483 A 11/1996 Williamson
5,580,207 A 12/1996 Kiebooms et al.
5,613,252 A 3/1997 Yu et al.
5,669,086 A 9/1997 Garman
5,687,437 A 11/1997 Goldsmith
5,690,185 A 11/1997 Sengel
5,697,623 A 12/1997 Bermes et al.
5,737,782 A 4/1998 Matsuura et al.
5,746,282 A 5/1998 Fujiwara et al.
5,749,424 A 5/1998 Reimers
5,775,456 A 7/1998 Reppas
5,778,996 A 7/1998 Prior et al.
5,806,111 A 9/1998 Heimbrock et al.
5,809,755 A 9/1998 Velke et al.
5,826,670 A 10/1998 Nan
5,839,528 A 11/1998 Lee
5,906,017 A 5/1999 Ferrand et al.
5,915,487 A 6/1999 Splittstoesser et al.
5,921,338 A 7/1999 Edmondson
5,927,414 A 7/1999 Kan et al.
5,934,694 A 8/1999 Schugt et al.
5,937,959 A 8/1999 Fujii et al.
5,937,961 A 8/1999 Davidson
5,941,342 A 8/1999 Lee
5,944,131 A 8/1999 Schaffner et al.
5,964,313 A 10/1999 Guy
5,964,473 A 10/1999 Degonda et al.
5,971,091 A 10/1999 Kamen et al.
5,983,425 A 11/1999 DiMucci et al.
5,987,671 A 11/1999 Heimbrock et al.
5,988,304 A 11/1999 Behrendts
5,996,149 A 12/1999 Heimbrock et al.
6,000,486 A 12/1999 Romick et al.
6,016,580 A 1/2000 Heimbrock et al.
6,035,561 A 3/2000 Paytas et al.
6,050,356 A 4/2000 Takeda et al.
6,059,060 A 5/2000 Kanno et al.
6,059,301 A 5/2000 Skarnulis
6,062,328 A 5/2000 Campbell et al.
6,065,555 A 5/2000 Yuki et al.
6,070,679 A 6/2000 Berg et al.
6,073,285 A 6/2000 Ambach et al.
6,076,208 A 6/2000 Heimbrock et al.

(56) References Cited

U.S. PATENT DOCUMENTS

| | | | | |
|---|---|---|---|---|
| 6,076,209 | A | 6/2000 | Paul | |
| 6,098,732 | A | 8/2000 | Romick et al. | |
| 6,105,348 | A | 8/2000 | Turk et al. | |
| 6,125,957 | A | 10/2000 | Kauffmann | |
| 6,131,690 | A | 10/2000 | Galando et al. | |
| 6,148,942 | A | 11/2000 | Mackert, Sr. | |
| 6,154,690 | A | 11/2000 | Coleman | |
| 6,173,575 | B1 | 1/2001 | Harada | |
| 6,173,799 | B1 | 1/2001 | Miyazaki et al. | |
| 6,179,074 | B1 | 1/2001 | Scharf | |
| 6,209,670 | B1 | 4/2001 | Fernie et al. | |
| 6,256,812 | B1 | 7/2001 | Bartow et al. | |
| 6,286,165 | B1 | 9/2001 | Heimbrock et al. | |
| 6,330,926 | B1 | 12/2001 | Heimbrock et al. | |
| 6,343,665 | B1 | 2/2002 | Eberlein et al. | |
| 6,390,213 | B1 * | 5/2002 | Bleicher | 180/65.1 |
| 6,469,263 | B1 * | 10/2002 | Johnson | 177/144 |
| 6,474,434 | B1 | 11/2002 | Bech | |
| 6,505,359 | B2 | 1/2003 | Heimbrock et al. | |
| 6,668,402 | B2 | 12/2003 | Heimbrock | |
| 6,668,965 | B2 | 12/2003 | Strong | |
| 6,725,956 | B1 * | 4/2004 | Lemire | 180/15 |
| 6,749,034 | B2 | 6/2004 | Vogel et al. | |
| 6,752,224 | B2 | 6/2004 | Hopper et al. | |
| 6,772,850 | B1 | 8/2004 | Waters et al. | |
| 6,877,572 | B2 | 4/2005 | Vogel et al. | |
| 6,945,697 | B2 | 9/2005 | Schuster | |
| 7,007,765 | B2 | 3/2006 | Waters et al. | |
| 7,011,172 | B2 | 3/2006 | Heimbrock et al. | |
| 7,014,000 | B2 | 3/2006 | Kummer et al. | |
| 7,083,012 | B2 | 8/2006 | Vogel et al. | |
| 7,090,041 | B2 | 8/2006 | Vogel et al. | |
| 7,090,042 | B2 * | 8/2006 | Coveyou | B62D 51/04 180/19.2 |
| 7,191,854 | B2 * | 3/2007 | Lenkman | 180/65.1 |
| 7,195,253 | B2 | 3/2007 | Vogel et al. | |
| 7,273,115 | B2 | 9/2007 | Kummer et al. | |
| 7,284,626 | B2 | 10/2007 | Heimbrock et al. | |
| 7,302,722 | B2 | 12/2007 | Karmer, Jr. et al. | |
| 7,407,024 | B2 | 8/2008 | Vogel et al. | |
| 7,472,438 | B2 | 1/2009 | Karmer, Jr. et al. | |
| 7,828,092 | B2 | 11/2010 | Vogel et al. | |
| 7,953,537 | B2 | 5/2011 | Bhai | |
| 8,056,950 | B2 | 11/2011 | Souke et al. | |
| 8,267,206 | B2 | 9/2012 | Vogel et al. | |
| 8,442,738 | B2 | 5/2013 | Patmore | |
| 8,757,308 | B2 | 6/2014 | Bhai et al. | |
| 8,914,924 | B2 * | 12/2014 | Stryker | A61G 7/001 5/600 |
| 9,271,887 | B2 * | 3/2016 | Schejbal | A61G 7/018 |
| 2002/0138905 | A1 | 10/2002 | Bartlett et al. | |
| 2002/0152555 | A1 | 10/2002 | Gallant et al. | |
| 2003/0097712 | A1 * | 5/2003 | Gallant et al. | 5/510 |
| 2003/0163226 | A1 | 8/2003 | Tan | |
| 2004/0124017 | A1 | 7/2004 | Jones et al. | |
| 2004/0133982 | A1 | 7/2004 | Horitani et al. | |
| 2004/0159473 | A1 * | 8/2004 | Vogel et al. | 180/9.1 |
| 2005/0199430 | A1 | 9/2005 | Vogel et al. | |
| 2006/0059623 | A1 | 3/2006 | Karmer, Jr. et al. | |
| 2006/0277683 | A1 * | 12/2006 | Lamire et al. | 5/600 |
| 2007/0010719 | A1 * | 1/2007 | Huster et al. | 600/300 |
| 2007/0163043 | A1 | 7/2007 | Lemire et al. | |
| 2007/0268147 | A1 | 11/2007 | Bhai | |
| 2009/0222184 | A1 * | 9/2009 | Bhai | 701/70 |
| 2009/0313758 | A1 * | 12/2009 | Menkedick et al. | 5/618 |
| 2011/0066287 | A1 * | 3/2011 | Flanagan | 700/275 |
| 2011/0083270 | A1 | 4/2011 | Bhai et al. | |
| 2012/0124743 | A1 * | 5/2012 | Hensley et al. | 5/600 |
| 2012/0144586 | A1 * | 6/2012 | Heimbrock et al. | 5/611 |
| 2012/0194436 | A1 * | 8/2012 | Thodupunuri et al. | 345/168 |
| 2012/0198620 | A1 * | 8/2012 | Hornbach et al. | 5/510 |
| 2014/0076644 | A1 * | 3/2014 | Derenne et al. | 180/19.2 |
| 2015/0014959 | A1 * | 1/2015 | Youngmann | A61G 5/006 280/400 |

FOREIGN PATENT DOCUMENTS

| | | | |
|---|---|---|---|
| CA | 2589811 | | 6/2006 |
| DE | 1 041 210 | | 10/1958 |
| DE | 94 20 429 | | 12/1994 |
| DE | 295 18 502 | U1 | 1/1997 |
| DE | 199 21 503 | | 4/2000 |
| EP | 0 062 180 | A2 | 10/1982 |
| EP | 0 093 700 | A2 | 11/1983 |
| EP | 0 204 637 | A1 | 12/1986 |
| EP | 0 329 504 | B1 | 8/1989 |
| EP | 0 352 647 | B1 | 1/1990 |
| EP | 0 403 202 | B1 | 12/1990 |
| EP | 0 420 263 | A1 | 4/1991 |
| EP | 0 630 637 | A1 | 12/1994 |
| EP | 0 653 341 | A1 | 5/1995 |
| EP | 0 776 637 | A1 | 6/1997 |
| EP | 0 776 648 | A1 | 6/1997 |
| EP | 0967535 | | 12/1999 |
| EP | 991529 | B1 | 4/2000 |
| EP | 2 422 758 | A2 | 2/2012 |
| FR | 2 714 008 | | 6/1995 |
| FR | 2 735 019 | | 12/1996 |
| FR | 2 746 060 | | 9/1997 |
| GB | 415450 | | 8/1934 |
| GB | 672557 | | 5/1952 |
| GB | 1 601 930 | | 11/1981 |
| GB | 2 285 393 | A | 7/1995 |
| JP | 46-31490 | | 9/1971 |
| JP | 47-814 | | 8/1972 |
| JP | 47-17495 | | 10/1972 |
| JP | 47-44792 | | 6/1973 |
| JP | 48-44792 | | 6/1973 |
| JP | 48-44793 | | 6/1973 |
| JP | 48-54494 | | 7/1973 |
| JP | 48-54495 | | 7/1973 |
| JP | 49-29855 | | 3/1974 |
| JP | 51-20491 | | 2/1976 |
| JP | 53-9091 | | 1/1978 |
| JP | 53-96397 | | 8/1978 |
| JP | 56-68523 | | 6/1981 |
| JP | 56-68524 | | 6/1981 |
| JP | 56-73822 | | 6/1981 |
| JP | 57-157325 | | 10/1982 |
| JP | 57-187521 | | 11/1982 |
| JP | 58 06357 | | 4/1983 |
| JP | 59-37946 | | 3/1984 |
| JP | 59-38176 | | 3/1984 |
| JP | 59-183756 | | 10/1984 |
| JP | 59-186554 | | 10/1984 |
| JP | 60-12058 | | 1/1985 |
| JP | 60-12059 | | 1/1985 |
| JP | 60-21751 | | 2/1985 |
| JP | 60-31749 | | 2/1985 |
| JP | 60-31750 | | 2/1985 |
| JP | 60-31751 | | 2/1985 |
| JP | 60-122561 | | 7/1985 |
| JP | 60-188152 | | 9/1985 |
| JP | 60-188153 | | 9/1985 |
| JP | 61 88727 | | 8/1986 |
| JP | 61-188727 | | 11/1986 |
| JP | 62-60433 | | 4/1987 |
| JP | 64-17231 | | 1/1989 |
| JP | 2-84961 | | 3/1990 |
| JP | 3-31063 | | 2/1991 |
| JP | 4-108525 | | 9/1992 |
| JP | 6-50631 | | 7/1994 |
| JP | 6-237959 | | 8/1994 |
| JP | 7-136215 | | 5/1995 |
| JP | 7 328074 | | 12/1995 |
| JP | 8-112244 | | 5/1996 |
| JP | 8-317953 | | 12/1996 |
| JP | 9-24071 | | 1/1997 |
| JP | 9-38154 | | 2/1997 |
| JP | 9-38155 | | 2/1997 |
| JP | 10-146364 | | 6/1998 |
| JP | 10-181609 | | 7/1998 |
| JP | 10-305705 | | 11/1998 |
| JP | 2000-107230 | | 4/2000 |

(56) References Cited

FOREIGN PATENT DOCUMENTS

| | | |
|---|---|---|
| JP | 2000-118407 | 4/2000 |
| JP | 2000-175974 | 6/2000 |
| WO | WO 82-01313 | 4/1982 |
| WO | WO 87/07830 | 12/1987 |
| WO | WO 94/16935 | 8/1994 |
| WO | WO 94-21505 | 9/1994 |
| WO | WO 95/20514 | 8/1995 |
| WO | WO 96/07555 | 3/1996 |
| WO | WO 96/33900 | 10/1996 |
| WO | WO 97/39715 | 10/1997 |
| WO | WO 99/01298 | 1/1999 |
| WO | WO 00/37222 | 6/2000 |
| WO | WO 00/51830 | 8/2000 |
| WO | WO 01/19313 | 3/2001 |
| WO | WO 01/85084 | 11/2001 |
| WO | WO 2005/028243 | 3/2005 |
| WO | WO 2005/068276 A1 | 7/2005 |
| WO | WO 2006/059200 A2 | 6/2006 |

OTHER PUBLICATIONS

Stryker Medical, 2040 Zoom™ Critical Care Bed Maintenance Manual, date unknown.
Motorvator 3 Product Features Webpage, May 10, 2000.
Stryker Corporation Zoom™ drive brochure, Mar. 2000.
Midmark 530 Stretcher Information, Midmark Catalog, p. 14.
Tri-Flex II by Burke, Inc., "Operation Manual Impulse Drive System," (2004).
European Search Report from EP 09250422 dated Feb. 19, 2010.

* cited by examiner

PERSON SUPPORT APPARATUS POWER DRIVE SYSTEM

This Application claims priority to U.S. Provisional Application Ser. No. 61/682,202 titled PERSON SUPPORT APPARATUS POWER DRIVE STATUS INDICATOR filed on Aug. 11, 2012, and U.S. Provisional Application Ser. No. 61/682,203 titled PERSON SUPPORT APPARATUS SCALE SYSTEM filed on Aug. 11, 2012, the contents of which are incorporated herein by reference.

BACKGROUND OF THE DISCLOSURE

This disclosure relates to person support apparatuses including power drive systems. More particularly, but not exclusively, one contemplated embodiment relates to a person support apparatus that includes a power drive system and a control system configured to trigger a response based on an engagement status of the power drive system with a surface. While various person support apparatuses including power drive systems have been developed, there is still room for improvement. Thus, a need persists for further contributions in this area of technology.

SUMMARY OF THE DISCLOSURE

In one contemplated embodiment, a person support apparatus comprises a lower frame, an upper frame, a drive structure, and a control system. The upper frame is movably supported above the lower frame. The drive structure is coupled to the upper frame and configured to selectively engage a surface to, when activated, propel the person support apparatus along the surface. The control system is configured to determine an engagement status of the drive structure with the surface and trigger a response based on the engagement status.

In another contemplated embodiment, a person support apparatus comprises a lower frame, an upper frame, a drive structure, and a control system. The upper frame is movably supported above the lower frame. The drive structure is coupled to the upper frame and configured to selectively engage a surface to, when activated, propel the person support apparatus along the surface. The control system is configured to determine an engagement status of the drive structure with the surface in response to a drive activation signal and trigger a response based on the engagement status.

In another contemplated embodiment, a method, comprising the steps of: receiving an input signal indicative of the position of an upper frame of a person support apparatus with respect to a reference; determining an engagement status of a drive structure coupled to the upper frame of a person support apparatus as a function of the input signal; and if the engagement status is greater than a predetermined value, alerting a user as to the engagement status of the drive structure.

In another contemplated embodiment, a method, comprising the steps of: receiving an input signal indicative of the position of an upper frame of a person support apparatus with respect to a reference; determining an engagement status of a drive structure coupled to the upper frame of a person support apparatus as a function of the input signal; and if the engagement status is less than a predetermined value, moving the upper frame to a predetermined position with respect to the reference.

In another contemplated embodiment, a person support apparatus comprises a lower frame, a lift system coupled to the lower frame, an upper frame, an input, and a control system. The upper frame is movably supported above the lower frame by the lift system. The input is configured to receive a signal indicative of a user's desire to weigh a person supported on the person support apparatus. The control system is configured to determine the height of the upper frame with respect to a reference and, if the upper frame is less than a predetermined height, cause the lift system to raise the upper frame to a weighing height.

In another contemplated embodiment, a person support apparatus comprises a lower frame, a lift system coupled to the lower frame, an upper frame, an input, and a control system. The upper frame is movably supported above the lower frame by the lift system. The input is configured to receive a signal indicative of a user's desire to weigh a person supported on the person support apparatus. The control system is configured to determine the height of the upper frame with respect to a reference and, if the upper frame is less than a predetermined height, alert a user that the upper frame must be raised.

In another contemplated embodiment, a method of weighing a person on a person support apparatus, comprising the steps of: receiving a weighing signal from an input; determining the height of an upper frame of a person support apparatus with respect to a reference; and if the height is less than a predetermined height, cause a lift system to increase the height of the upper frame to a predetermined weighing height.

In another contemplated embodiment, a person support apparatus comprises a lower frame, a lift system coupled to the lower frame, an upper frame, an input, and a control system. The upper frame is movably supported above the lower frame by the lift system. The input is configured to receive a signal indicative of a user's desire to weigh a person supported on the person support apparatus. The control system is configured to determine the position of the upper frame with respect to a reference and, if the upper frame is less than a predetermined distance above the reference, at least one of cause the lift system to raise the upper frame to a predetermined weighing position and alert a user that the upper frame must be raised.

In another contemplated embodiment, a person support apparatus comprises a lower frame, a lift system coupled to the lower frame, an upper frame, a power drive system coupled to the upper frame, an input, and a control system. The upper frame is movably supported above the lower frame by the lift system. The power drive system is coupled to the upper frame and configured to selectively engage a surface to, when activated, propel the person support apparatus along the surface. The input is configured to receive a signal indicative of a user's desire to activate the power drive system. The control system is configured to determine the position of the upper frame with respect to a reference and, if the upper frame is greater than a predetermined distance above the reference, at least one of cause the lift system to lower the upper frame to a predetermined power drive system engagement position and alert a user that the upper frame must be lowered.

In another contemplated embodiment, a person support apparatus comprises a lower frame, a lift system coupled to the lower frame, an upper frame, a power drive system, an input, and a control system. The upper frame is movably supported above the lower frame by the lift system. The power drive system is coupled to the upper frame and configured to selectively engage a surface to, when activated, propel the person support apparatus along the surface. The input is configured to receive a signal indicative of a user's desire to activate the power drive system. The control system is configured to determine the position of the upper frame with respect to a reference and, if the upper frame is less than a predetermined distance above the reference, alert a user that the upper frame must be lowered.

In another contemplated embodiment, a method engaging a power drive system coupled to a person support apparatus with a surface, comprising the steps of: receiving a power drive activation signal from an input; determining the height of an upper frame of a person support apparatus with respect to a reference; and if the height is greater than a predetermined height, cause a lift system to at least one of decrease the height of the upper frame to a predetermined power drive engagement height and alert a user that the upper frame must be lowered.

Additional features, which alone or in combination with any other feature(s), such as those listed above and/or those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
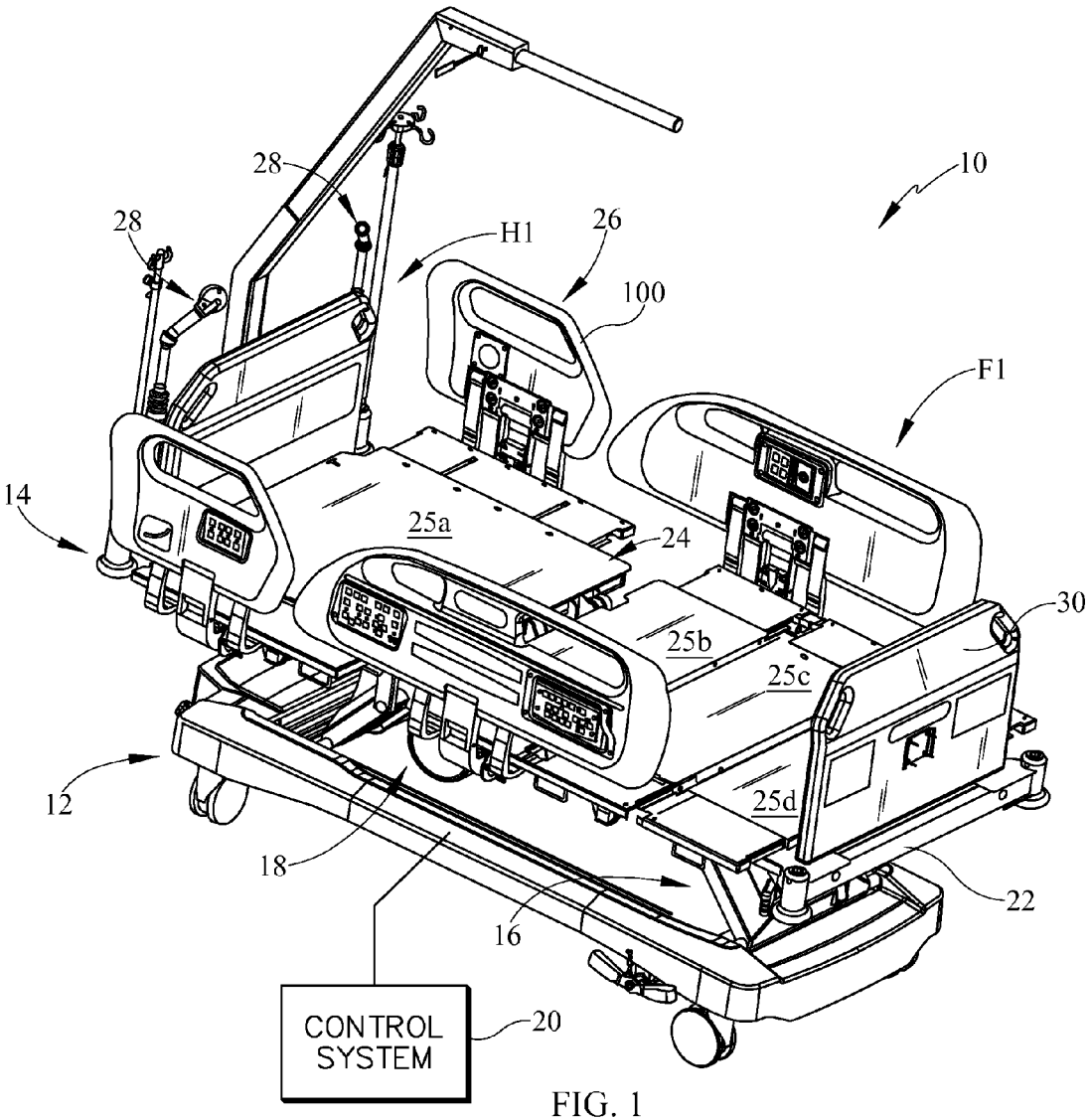
FIG. 1 is a perspective side view of a person support apparatus according to one illustrative embodiment of the current disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

Figure 5:
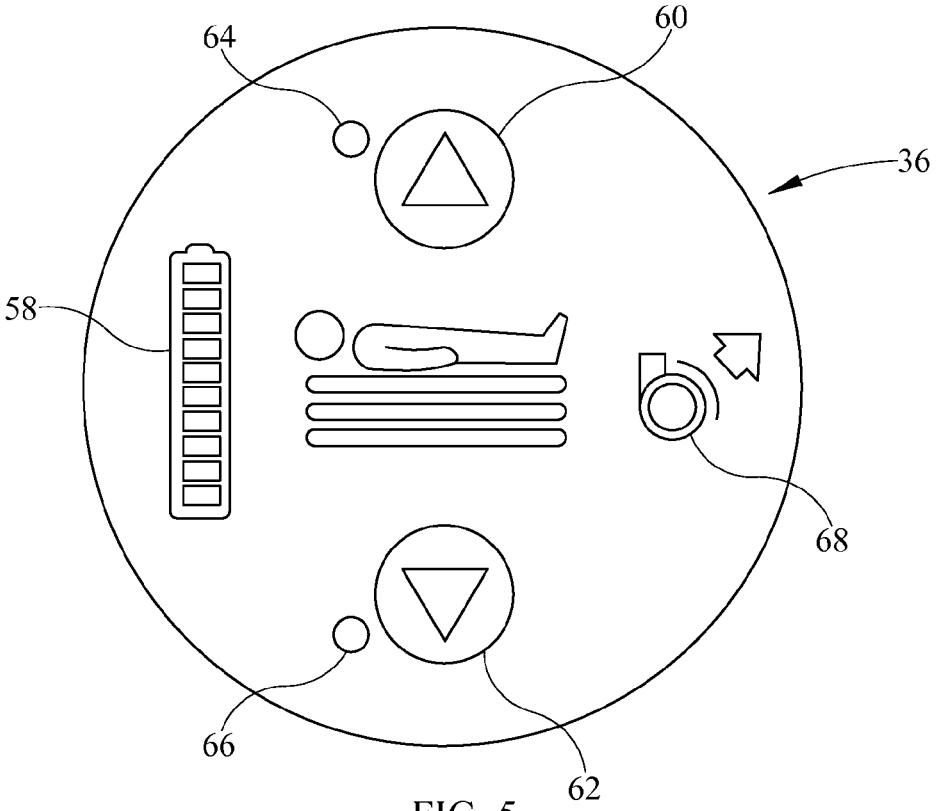
FIG. 5 is a top view of the user interface coupled to the handle of the movement controls of FIG. 3.
Figure 6:
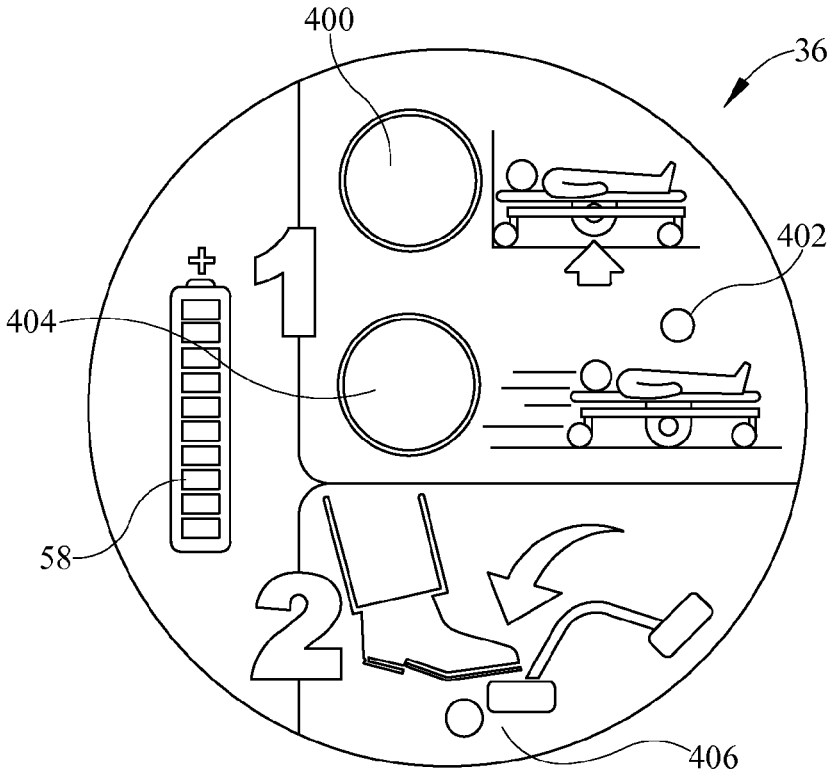
FIG. 6 is a top view of the user interface coupled to the handle of the movement controls of FIG. 3 according to another contemplated embodiment.
Figure 7:
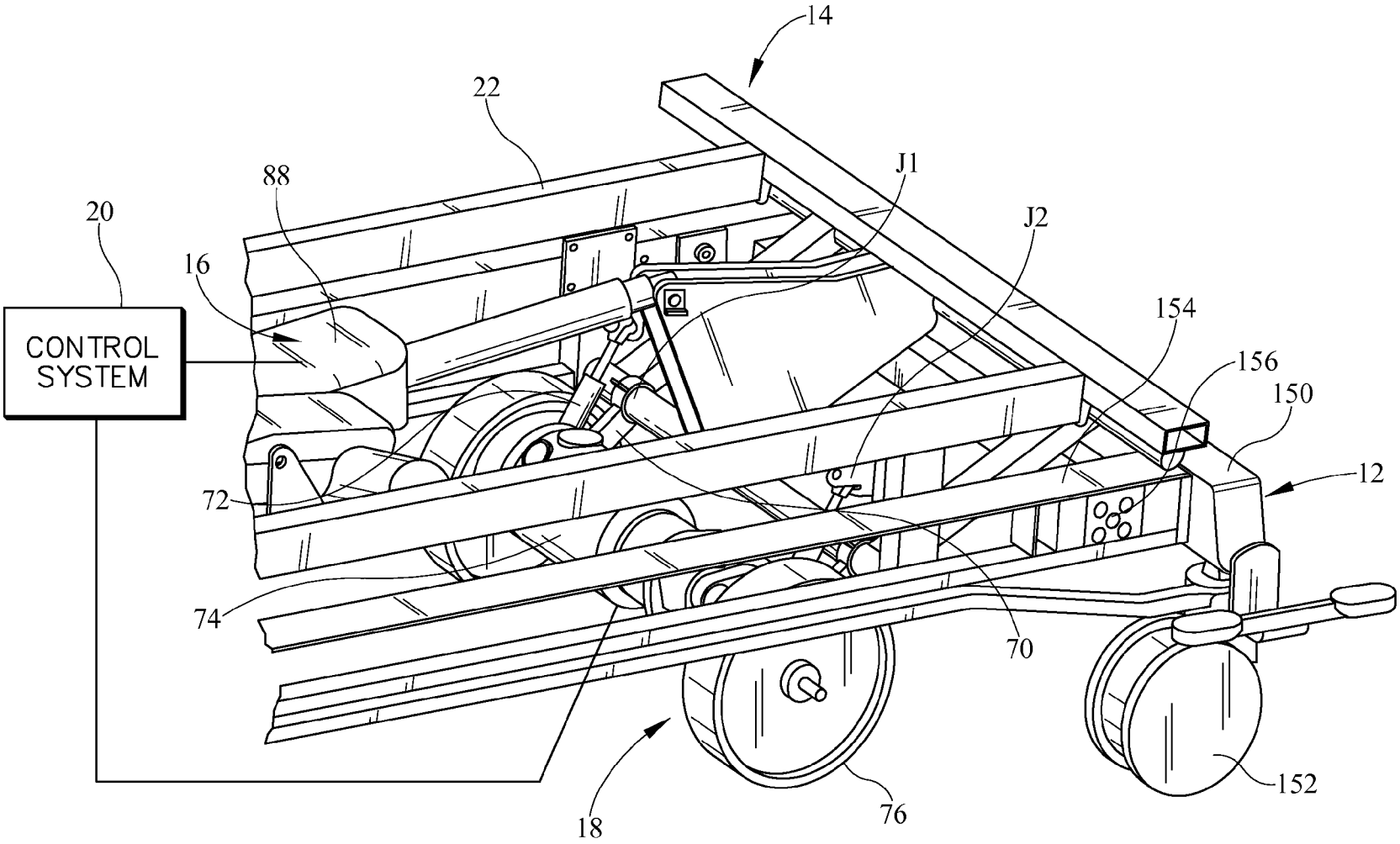
FIG. 7 is a perspective side view of the lower frame, upper frame, and power drive system of the person support apparatus of FIG. 1.

A person support apparatus 10 according to one contemplated embodiment is shown in FIGS. 1-11. The person support apparatus 10 is a hospital bed and includes a head section H1, where the head of a person (not shown) can be positioned, and a foot section F1, where the feet of a person (not shown) can be positioned. In some contemplated embodiments, the person support apparatus 10 can be a stretcher, a wheelchair, or other person support device. The person support apparatus 10 includes a lower frame 12 or base 12, an upper frame 14, a plurality of lift systems 16 coupled with the upper frame 14 and the lower frame 12, a power drive system 18 or drive structure 18, and a control system 20 as shown in FIGS. 1 and 7. In some contemplated embodiments, a mattress (not shown) is supported on the upper frame 14. The lower frame 12 includes a base beam 150 connecting the pairs of casters 152 at the ends of the person support apparatus 10, and a weigh frame 154 that extends between the base beams 150 and includes a load cell 156 configured to sense a load supported on the upper frame 14 as shown in FIG. 7. The lift systems 16 are configured to move the upper frame 14 with respect to the lower frame 12, for example, between raised and lowered positions and between Trendelenburg and reverse Trendelenburg positions.

The upper frame 14 includes an intermediate frame 22, a deck 24, a plurality of siderails 26, a plurality of movement controls 28, and a plurality of endboards 30 as shown in FIG. 1. The deck 24 is comprised of multiple sections (a head section 25*a*, a foot section 25*b*, a seat section 25*c*, and a thigh section 25*d*) that are configured to be moved between various articulated configurations with respect to the intermediate frame 22. In some contemplated embodiments, a portion of the deck 24 is configured to extend laterally to increase the overall width of the deck 24. The siderails 26 are movably coupled to the intermediate frame 22 and are configured to cooperate with the endboards 30 to define the perimeter of the upper frame 14 and assist with ingress/egress to/from the upper frame 14. In some contemplated embodiments, the siderails 26 and/or the endboards 30 are coupled to the deck 24 instead of the intermediate frame 22.

Figure 2:
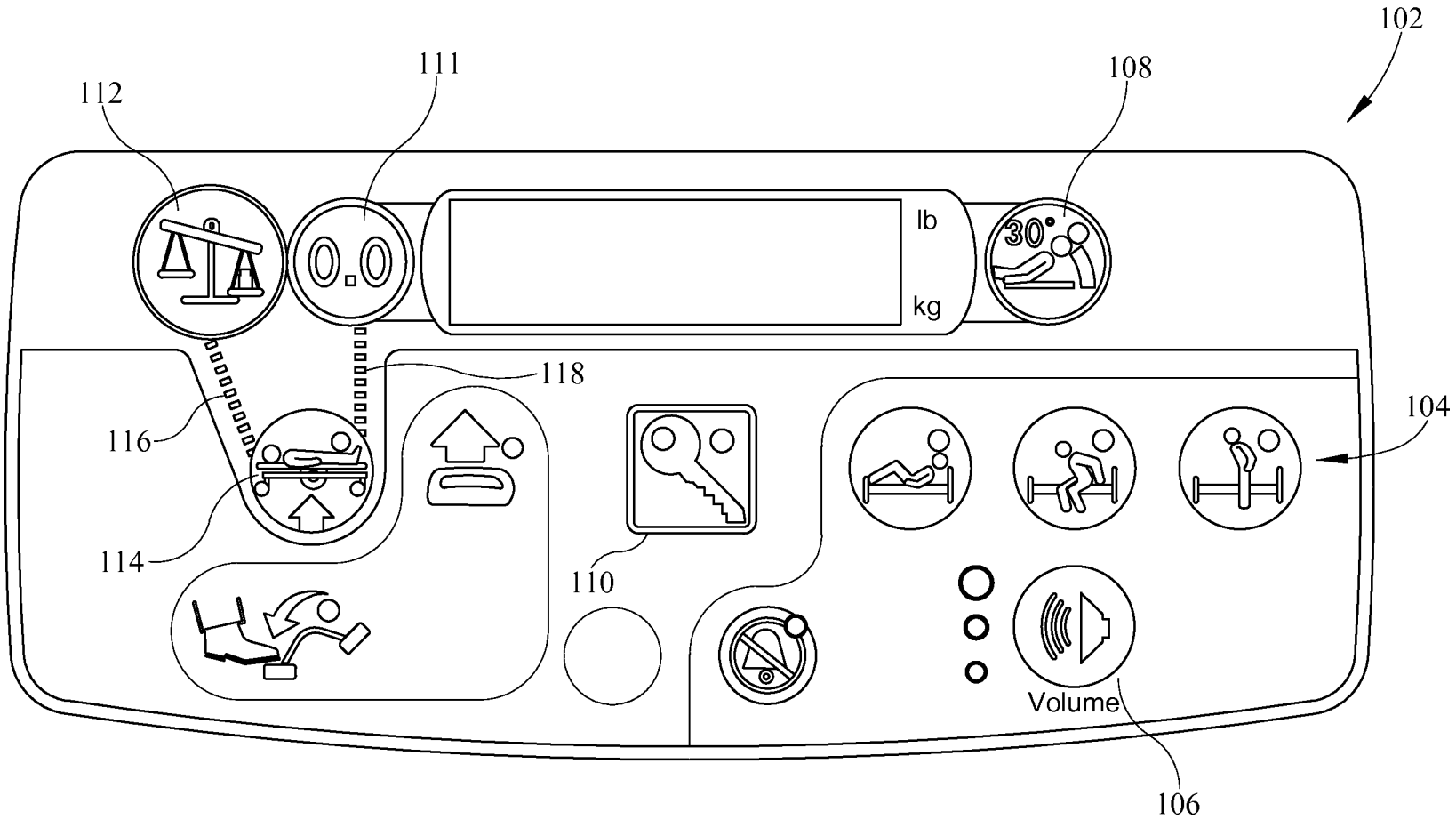
FIG. 2 is a front view of a user interface coupled to a siderail of the person support apparatus of FIG. 1.
Figure 3:
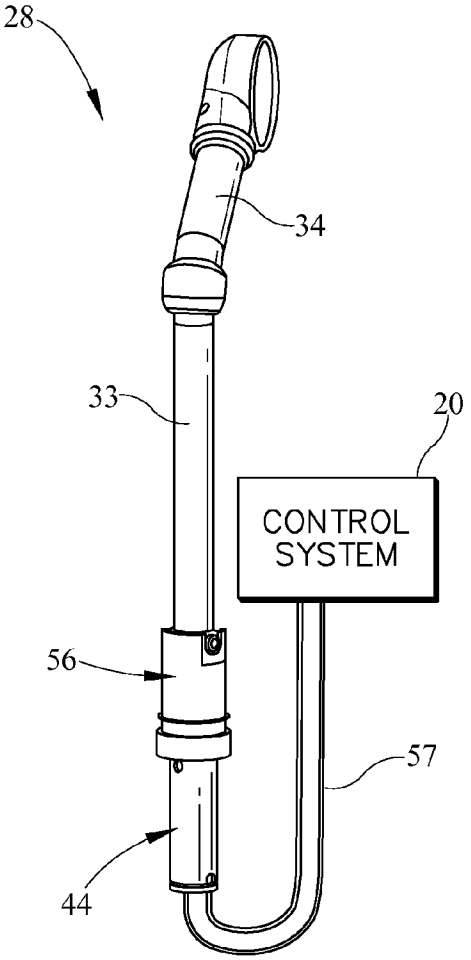
FIG. 3 is a perspective side view of the movement controls of the person support apparatus of FIG. 1.
Figure 4:
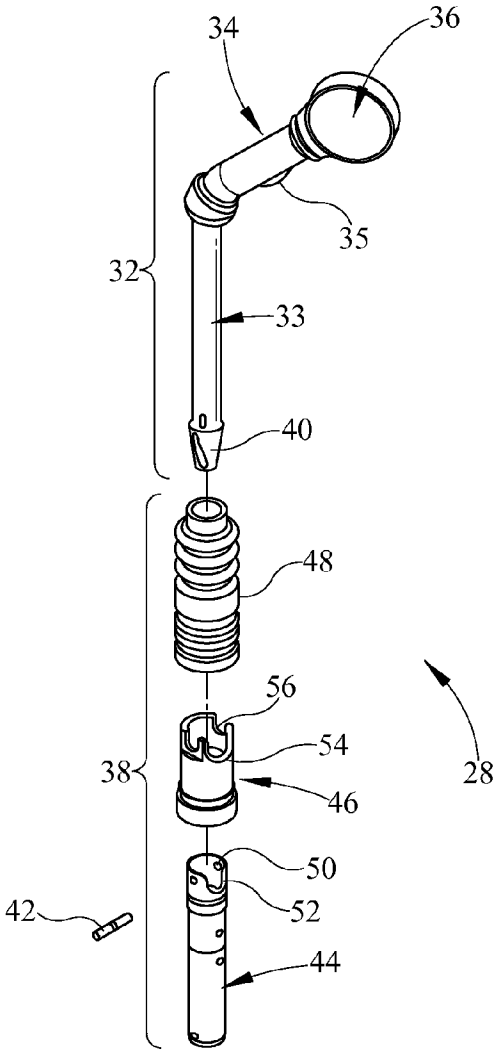
FIG. 4 is an exploded view of the movement controls of FIG. 4.

The siderails 26 include a siderail body 100 and a graphical user interface 102 coupled to the siderail body 100 and electrically coupled to the control system 20. The user interface 102 is configured to provide input signals to the control system 20 that correspond to one or more functions of the person support apparatus 10 selected by a user. The user interface 102 is also configured to receive output signals from the control system 20 to communicate information to the user. As shown in FIG. 2, the user interface 102 includes bed exit alarm buttons 104, an alarm volume button 106, a head angle alarm button 108, a lock button 110, a zero scale button 111, and weigh button 112. In other contemplated embodiments, the user interface 102 can include a touch screen interface be implemented using a combination of touch screen interfaces and buttons. The bed exit alarm buttons 104 are configured to allow a user to select the sensitivity of the bed exit alarms. In one contemplated embodiment, there are three bed exit alarm buttons 104 corresponding to three sensitivities, including, alerting a person when: movement by a person supported on the bed exceeds a predetermined threshold; the person is positioned at the edge of the bed; and the person no longer being supported on the bed. The alarm volume button 106 is configured to allow a user to select the volume level of the alarms. In one contemplated embodiment, the alarm volume button 106 is pressed once for a low sound level, twice for a medium sound level, and three times for a high sound level. In some contemplated embodiments, the alarm volume button 106 is pressed a fourth time to go from the high sound level back to the low sound level. The head angle alarm button 108 is configured to cause the control system 20 to set an alarm that alerts a person when the angle of inclination the head deck section 25*a* is less than a predetermined angle of inclination. In some contemplated embodiments, the head angle alarm can be set at 30°. The lock button 110 is configured to cause the control system 20 to lock out the user interface 102 so that a patient cannot access the controls on the user interface 102. The zero scale button 111 is configured to reset the weigh scale to zero prior to placing a patient on the person support apparatus 10.

The weigh button 112 is configured to cause the control system 20 to weigh the occupant supported on the person support apparatus 10. In order for a user to get a more accurate weight reading, the upper frame must be positioned at or above a predetermined height so that the power drive system 18 no longer engages the floor. If the power drive system 18 engages the floor, then some of the weight of the occupant and upper frame 14 will be supported by the power drive system 18, which could lead to less accurate measurements. In one contemplated embodiment, when the weigh button 112 is pressed, a weigh signal is sent to the control system 20, which causes the control system 20 to determine whether the upper frame 14 is at or above a predetermined height. In some contemplated embodiments, the predetermined height is the height of the upper frame 14 when the power drive system 18 is 4 inches above the floor. In some contemplated embodiments, the predetermined height is the height of the upper frame 14 when the power drive system 18 no longer engages the floor. If the upper frame is not above the predetermined height, the control system 20 generates an output signal that causes the person support apparatus 10 to perform one or more functions. One function includes the control system 20 activating the lift system 16 to automatically raise the upper frame 14 to the predetermined height so that the user can weigh the patient. Another function includes the control system 20 illuminating a raise indicator 114 on the user interface 102 to indicate to the user that the user needs to raise the upper frame 14. In some contemplated embodiments, the indicator 114 remains activated until the user raises the upper frame 14 above the predetermined height. In some contemplated embodiments, the indicator 114 can flash to indicate that the upper frame 14 is not at the proper height to weigh the patient, and continue to remain flashing until the upper frame 14 is at or above the predetermined height. In some contemplated embodiments, the indicator 114 is a light emitting diode. In some contemplated embodiments, if the upper frame 14 is at or above the predetermined height then the user can zero the scale when the person support apparatus 10 is unoccupied and weigh the person when they are supported on the person support apparatus 10. In some contemplated embodiments, the control system 20 zeros the scale automatically upon the upper frame reaching or exceeding the predetermined height. In some contemplated embodiments, a first line of indicators 116 connects the raise indicator 114 and the weigh button 112 and a second line of indicators 118 connects the raise indicator 114 and the zero scale button 111. The first line of indicators 116 are illuminated when the upper frame 14 needs to be raised after the weigh button 112 is pressed and the second line of indicators 118 is illuminated when the upper frame 14 is at a predetermined height and the user needs to zero the scale.

The movement controls 28, as shown in 1, 3 and 4, are coupled to the head end H1 of the intermediate frame 22 and provide an input to the control system 20 to control the operation of the power drive system 18. In some contemplated embodiments, the movement controls 28 are coupled to other portions of the intermediate frame 22 or deck 24. The movement controls 28 comprise a handle assembly 32 including a shaft 33 and a grip portion 34, a user interface 36 coupled to the handle assembly 32, and a base assembly 38 configured to be removably coupled to the intermediate frame 22. The shaft 33 includes a slot 40 configured to receive a pin 42 to pivotably couple the handle assembly 32 to the base assembly 38. The grip portion 34 includes a trigger 35 that, when pressed, causes the control system 20 to activate the power drive system 18.

The base assembly 38 includes a shaft 44, a sleeve 46, and a shroud 48. The shaft 44 is configured to be inserted through the sleeve 46 into a hole (now shown) passing through the head end H1 of the intermediate frame 22 and includes an pin opening 50 and a recessed portion 52. The pin opening 50 is configured to receive the pin 42 to pivotably couple the handle assembly 32 to the base assembly 38. The recessed portion 52 is configured to engage the shaft 33 when the handle assembly 32 is moved from a use position, where the shaft 33 and the shaft 44 are substantially concentrically aligned, to a storage position, where the shaft 33 is substantially perpendicular to the shaft 44. The sleeve 46 is configured to engage the intermediate frame 22 and the pin 42 to removably maintain the shaft 44 within the hole in the intermediate frame 22. The sleeve 46 includes a recessed portion 54 and a pin engaging portion 56. The recessed portion 54 is configured to be aligned with the recessed portion 52 of the shaft 44 when the pin 42 is positioned within the pin opening 50 and the ends of the pin 42 engage the recessed pin engaging portions 56 of the sleeve 46. The shroud 48 is configured to be positioned over the sleeve 46 and the shaft 4 to cover the portion of the movement controls 28 where the handle assembly 32 is pivotably coupled to the base assembly 38.

The user interface 36 is coupled to the end of the grip portion 34 and is connected to the control system 20 via wires 57 that pass through the handle assembly 32 and base assembly 38. The user interface 36 includes a battery charge level indicator 58, a raise upper frame button 60, a lower upper frame button 62, a raised indicator 64, a lowered indicator 66, and a brake position indicator 68 as shown in FIG. 5. In another contemplated embodiment, the user interface 36 includes a battery charge level indicator 58, a raise upper frame/disengage power drive system button 400, a power drive engagement status indicator 402, a lower upper frame/engage power drive system button 404, and a brake/steer indicator 406 as shown in FIG. 6. In some contemplated embodiments, the power drive system 18 will not activate until the power drive engaged indicator 402 and the brake/steer indicator 406 both indicate the person support apparatus 10 is ready for transport. When a user presses the raise upper frame button 60, a raise signal is communicated to the control system 20 and causes the control system 20 to activate the lift system 16 to raise the upper frame 14 with respect to the lower frame 12. In some contemplated embodiments, when the upper frame 14 is at or above a predetermined height where a patient can be weighed, the raised indicator 64 is activated. In some contemplated embodiments, the raised indicator 64 can be activated while the raise upper frame button 60 is pressed to let the user know that the button 60 has been pressed and the upper frame 14 should be rising. In some contemplated embodiments, the raised indicator 64 is activated when the upper frame 14 is in its highest position with respect to the lower frame 12. In some contemplated embodiments, the raised indicator 64 can flash when the upper frame 14 needs to be raised to a position where an occupant can be weighed. In some contemplated embodiments, the raised indicator 64 can flash while the upper frame 14 is being raised and can stay activated once the highest position is reached.

When a user presses the lower upper frame button 62, a lower signal is communicated to the control system 20 and causes the control system 20 to activate the lift system 16 to lower the upper frame 14 with respect to the lower frame 12. In some contemplated embodiments, when the upper frame 14 is at or below a predetermined height where the power drive system 18 fully engages the floor and transport of the person support apparatus 10 can begin, the lowered indicator 66 is activated. In some contemplated embodiments, the lowered indicator 66 flashes if the upper frame 14 is not at or below the predetermined height and the power drive system 18 does not fully engage the floor. In some contemplated embodiments, the lowered indicator 66 can be activated while the lower upper frame button 62 is pressed to let the user know that the button has been pressed and the upper frame 14 should be lowering. In some contemplated embodiments, the lowered indicator 66 flashes when the upper frame 14 needs to be lowered to a height where the power drive system 18 engages the floor. In some contemplated embodiments, the lowered indicator 66 can flash while the upper frame 14 is being lowered and can stay activated once the lowest position is reached.

Figure 8:
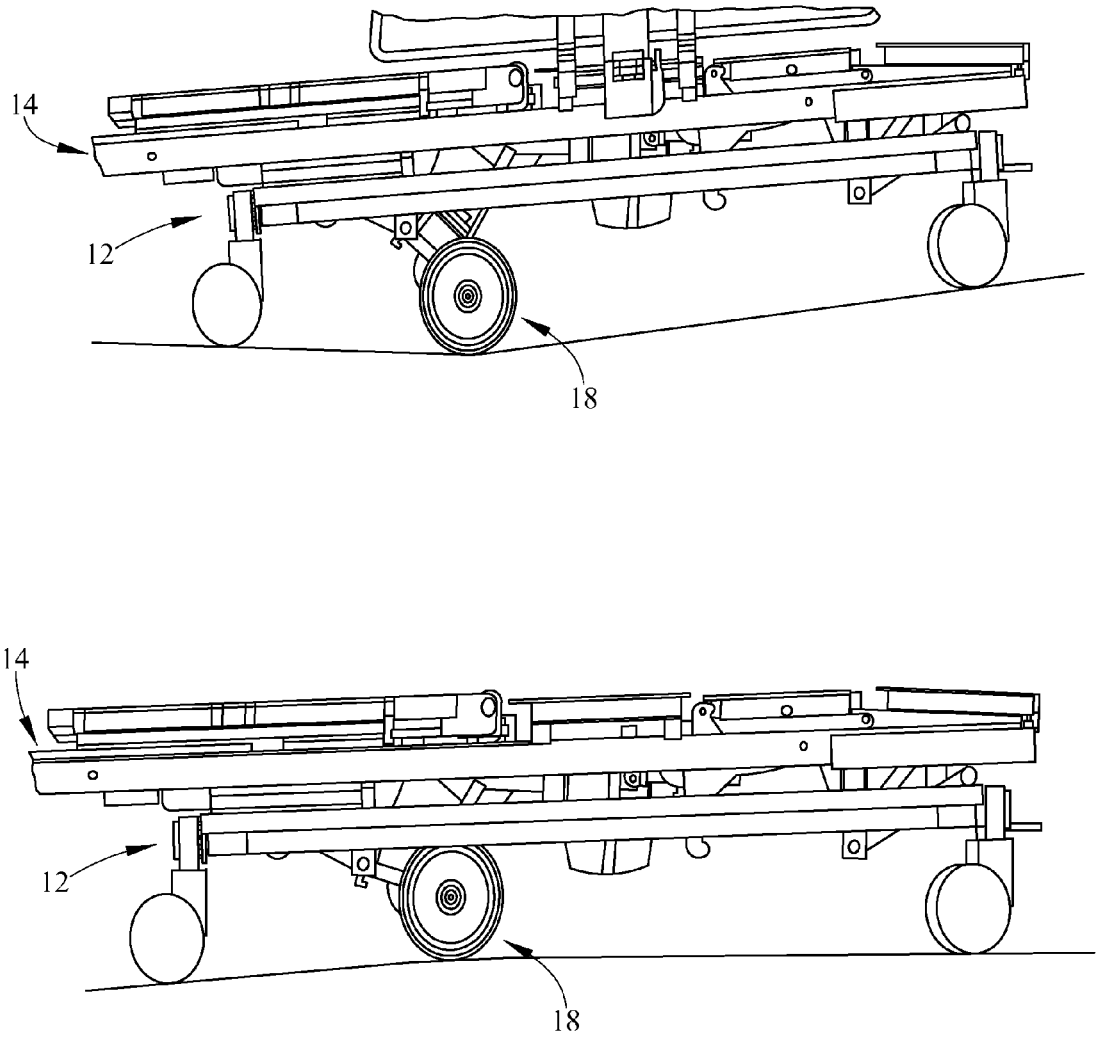
FIG. 8 is a diagrammatic view of the control system of the person support apparatus of FIG. 1.

The power drive system 18 is configured to assist a caregiver in moving the person support apparatus 10 from a first location to a second location by propelling the person support apparatus 10 when activated. In one contemplated embodiment, the power drive system 18 includes the Intellidrive® transport system sold by Hill-Rom. The power drive system 18 is coupled to the upper frame 14 and is configured to be raised and lowered with the upper frame 14, which causes the power drive system 18 to disengage and engage the floor. The power drive system 18 is pivotably coupled to the intermediate frame 22 at a first joint J1 by a bracket 70 and is pivotably coupled to the intermediate frame 22 at a second joint J2 by a damper 72 as shown in FIG. 7. In some contemplated embodiments, the power drive system 18 is pivotably coupled to the intermediate frame 22 at a second joint J2 by a biasing element 72 configured to bias the power drive system toward engagement with the floor. The pivotable connection of the power drive system 18 to the intermediate frame 22 allows for the power drive system 18 to maintain engagement with the floor when the person support apparatus 10 moves over uneven surfaces, for example, when the person support apparatus 10 begins to move up or down a ramp as shown in FIG. 8. The power drive system 18 includes an electric motor 74 with an axle (not shown) that connects the motor 74 to a pair of wheels 76. In some contemplated embodiments, the wheels 76 engage a belt (not shown) that engages the floor. The motor 74 is configured to rotate the wheels 76 in response to a user activating the trigger 35 on the movement controls 28 and pushing or pulling the person support apparatus 10.

Figure 9:
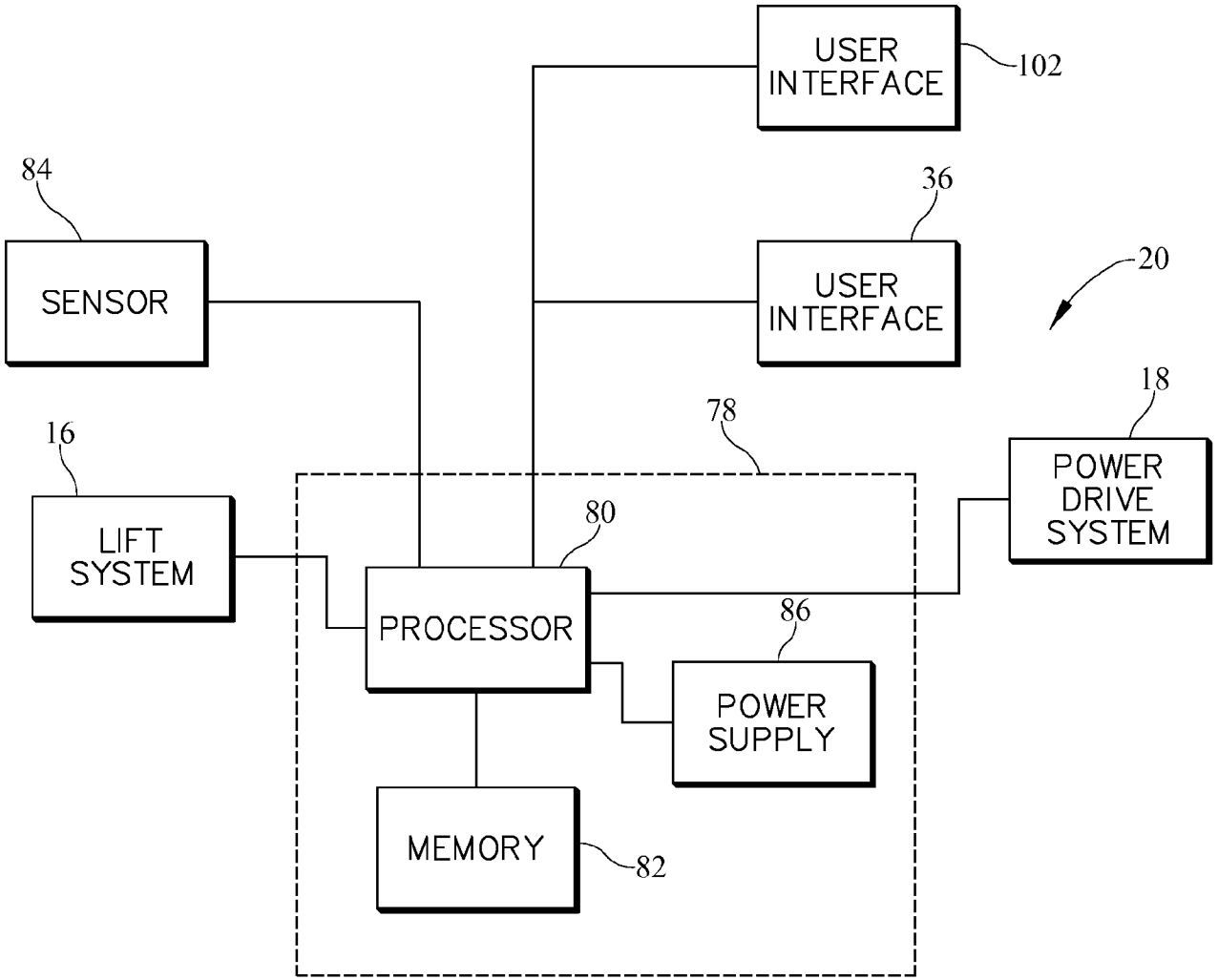
FIG. 9 is a side view of the power drive system of the person support apparatus of FIG. 1 engaging uneven surfaces.

The control system 20 is configured to control at least one function of the person support apparatus 10. The control system 20 comprises a sensing element 84 and controller 78 including a processor 80, a memory unit 82, and a power supply 86 as shown in FIG. 9. The processor 80 is electrically coupled to the memory 82, the power supply 86, the sensing element 84, the user interface 36, the user interface 102, the motor 74 of the power drive system 18, and the actuators 88 of the lift system 16.

The sensing element 84 is coupled to at least one of the upper frame 14, the lower frame 12, and the lift system 16, and is configured to determine the height of the upper frame 14 with respect to the lower frame 12. In one contemplated embodiment, the sensing element 84 includes a potentiometer positioned within the actuator 88 that is configured to measure the amount the actuator travels as the lift system 16 moves the upper frame 14 with respect to the lower frame 12. In some contemplated embodiments, the potentiometer is rotated by a motor (not shown) that rotates at a rate proportional to the rate the upper frame 14 moves with respect to the lower frame 12. In another contemplated embodiment, the sensing element 84 includes an ultrasonic distance sensor configured to measure the distance between the lower frame 12 and the upper frame 14. In some contemplated embodiments, the sensing element 84 includes a hall-effect sensor that is configured to sense when the actuator 88 is extended or retracted a predetermined distance to determine the position of the upper frame 14 with respect to the lower frame 12. In some contemplated embodiments, the actuator 88 includes limit switches (not shown) that detect when the actuator 88 is extended and retracted a predetermined distance and the control box (not shown) configured to generate an output signal when the limit switches have been activated. In some contemplated embodiments, the sensing element 84 includes limit switches that are placed on the upper frame 14 or lower frame 12 and are triggered when the upper frame 14 is in its lowest position with respect to the lower frame 12 and/or does not engage the floor. In some contemplated embodiments, the sensing element 84 includes a current sensor that monitors the electrical current supplied to the lift system 16 to determine the position of the actuator 88. In some contemplated embodiments, the sensing element 84 includes a sensor, such as, a limit switch, coupled to the damper 72 to sense when the damper 72 is extended or retracted a predetermined amount to determine if the upper frame 14 is in its lowest position where the power drive system 18 engages the floor, or in a position where a person can be weighed. In some contemplated embodiments, the sensing element 84 includes a limit switch coupled to the upper frame 14 that is activated when the power drive system 18 is pivoted with respect to the upper frame 14 such that the power drive system 18 is in the fully engaged position or the fully disengaged position. In other contemplated embodiments, other methods of determining the distance between the upper frame 14 and the lower frame 12 or the rotational position of the power drive system 18 with respect to the upper frame 14 are contemplated. Other sensing elements 84 configured to sense a characteristic of the person support apparatus 10 that is indicative of or relating to the position of the upper frame 14 or power drive 18 with respect to a reference, or the engagement status of the power drive 18 are contemplated.

Figure 10:
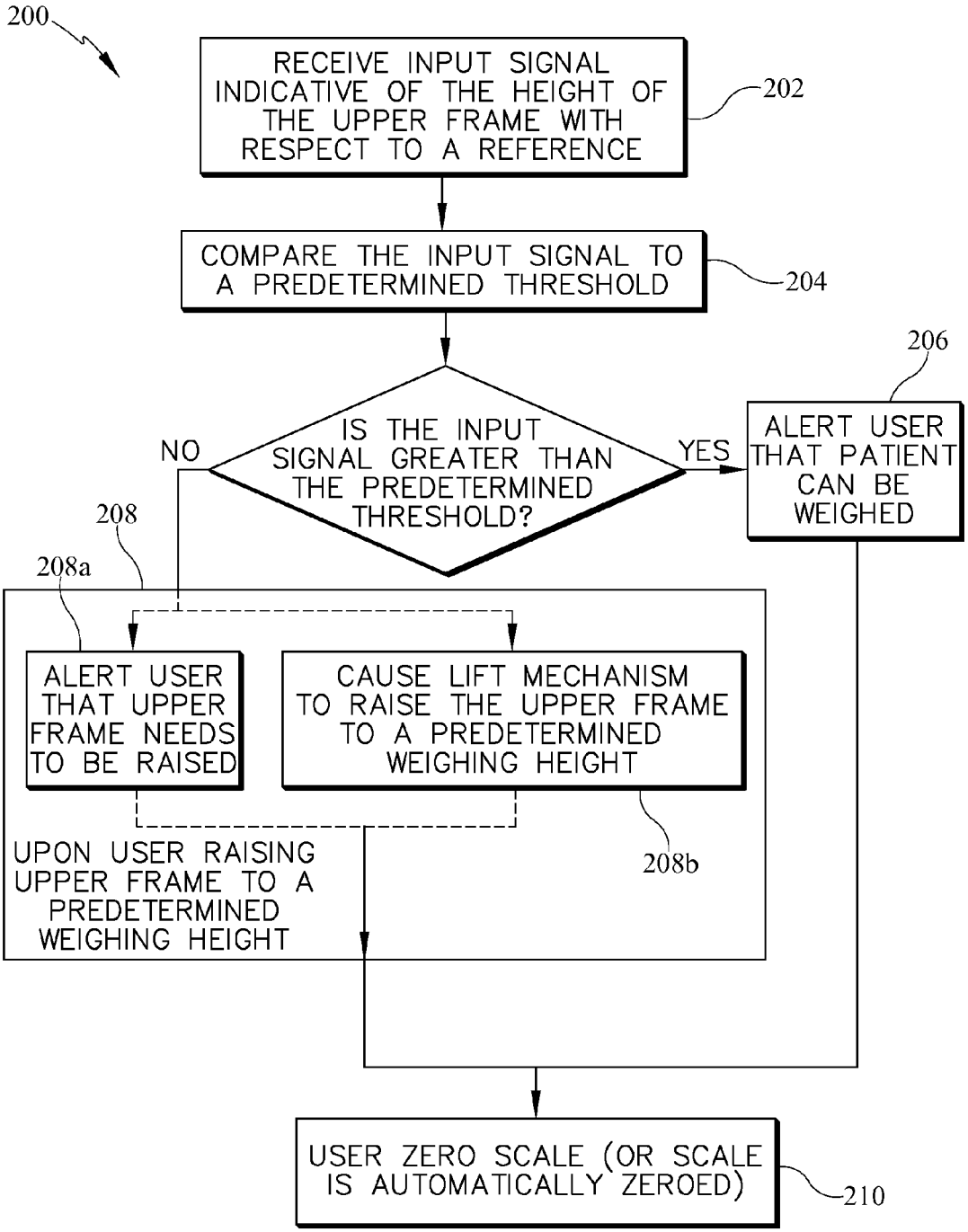
FIG. 10 is a flow chart of a procedure for determining if the power drive system engages the floor based on the height of the upper frame with respect to a reference.

The memory 82 stores instructions that the processor 80 executes to control the operation of the person support apparatus 10. In one contemplated embodiment, the instructions cause the processor 80 to generate an output signal in response to an input signal from a user that is indicative of the user's desire to weigh an occupant supported on the person support apparatus 10. In some contemplated embodiments, when the user presses the weigh button 112, a weigh signal is generated that is communicated to the processor 80. The weigh signal causes the processor 80 to execute instructions that follow a procedure 200 as shown in FIG. 10.

Procedure 200 beings with step 202 where the processor 80 receives a sensed signal from the sensing element 84 indicative of the height of the upper frame 14 with respect to a reference. In some contemplated embodiments, the reference includes a surface of a floor or the lower frame 12.

In step 204 the processor 80 compares the input signal to a predetermined threshold stored in memory 82.

If the sensed signal exceeds the predetermined threshold then the processor 80 proceeds to step 206 where the processor 80 generates an output signal to alert a user that the person support apparatus 10 is in a position where the occupant can be weighed.

If the input signal does not exceed the predetermined threshold, the processor 80 proceeds to step 208 where the processor 80 generates an output signal that causes the person support apparatus 10 to perform a function. In one contemplated embodiment, the output signal is used to alert the user that the upper frame 14 needs to be raised before the occupant can be weighed. In one example, the output signal causes the lift system 16 to raise the upper frame 14 to a predetermined weighing height in step 208*a*. In another example, the output signal causes the indicator 114 to be illuminated in step 208*b* to inform the user that the upper frame needs to be raised before the occupant can be weighed. In some contemplated embodiments, the indicator 114 can flash until the user raises the upper frame 14 to a predetermined weighing height and then remain illuminated to indicate the upper frame 14 is at the predetermined weighing height. In another contemplated embodiment, Once at the predetermined weighing height, the scale must be zeroed before the occupant is weighed 210. In some contemplated embodiments, the user must zero the scale. In some contemplated embodiments, the processor 80 automatically zeros the scale upon determining that the person support apparatus 10 is in a position where the occupant can be weighed.

Figure 11:
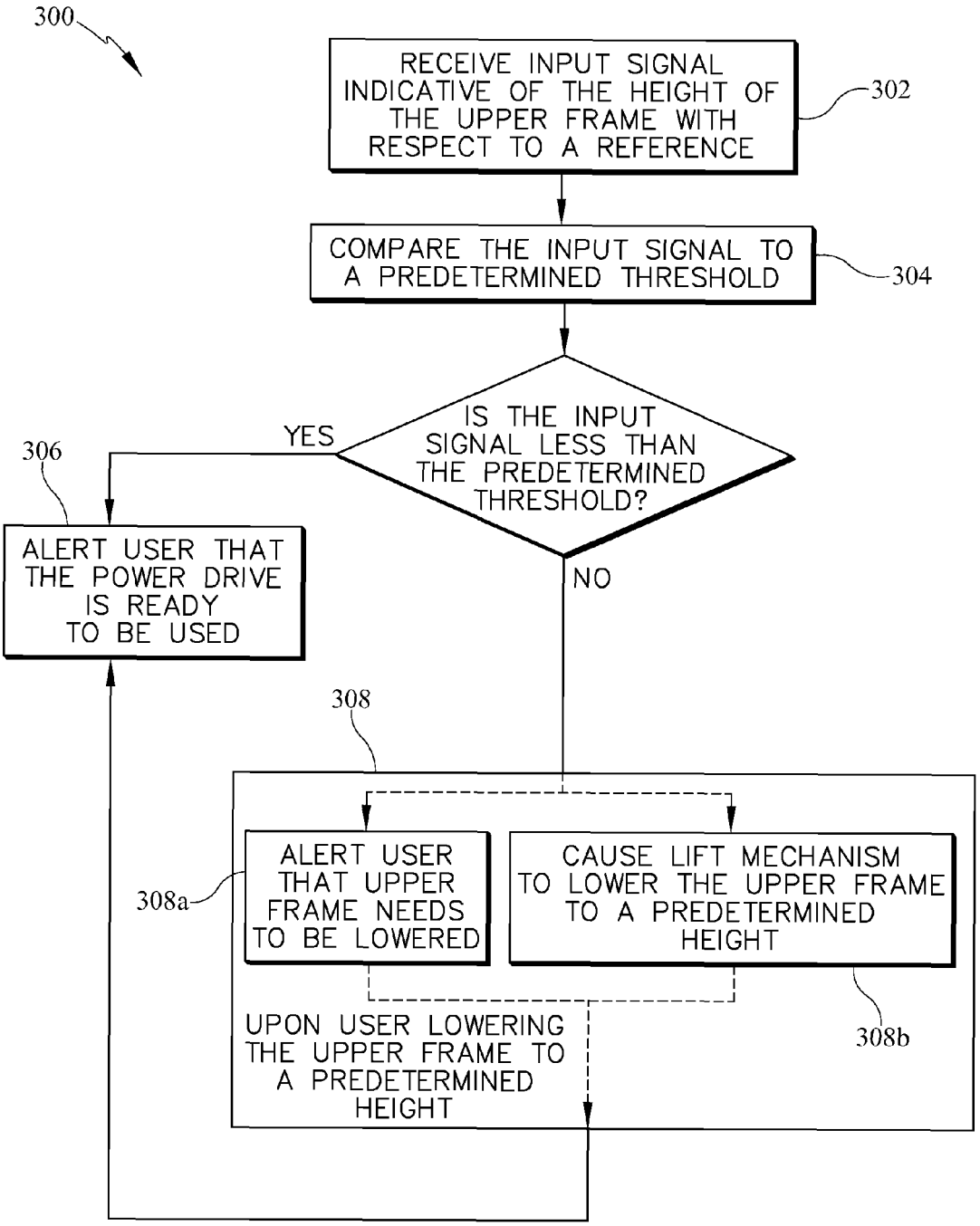
FIG. 11 is a flow chart of a procedure for determining if the upper frame is above a predetermined height with respect to a reference so that a user can weigh a person supported on the person support apparatus.

In another contemplated embodiment, the instructions cause the processor 80 to generate an output signal in response to an input signal from the user indicative of the user's desire to activate the power drive system 18. In some contemplated embodiments, when the user actuates the trigger 35, a drive signal is generated and is communicated to the processor 80. The drive signal causes the processor 80 to execute instructions that follow a procedure 300 as shown in FIG. 11. Procedure 300 beings with step 302 where the processor 80 receives a sensed signal from the sensing element 84 indicative of the height of the upper frame 14 with respect to a reference.

In step 304 the processor 80 compares the sensed signal to a predetermined threshold stored in memory 82.

If the sensed signal is less than the predetermined threshold, the processor 80 proceeds to step 306 where the processor 80 generates an output signal that alerts a user that the person support apparatus 10 is in a position where the power drive system 18 is ready for use.

If the sensed signal exceeds the predetermined threshold, the processor 80 proceeds to step 308 where the processor 80 generates an output signal that causes the person support apparatus 10 to perform a function. In one contemplated embodiment, the output signal is used to alert the user that the upper frame 14 needs to be lowered before the power drive system 18 can be used. In one example, the output signal causes the lift system 16 to lower the upper frame 14 to a predetermined height where the power drive system 18 is ready for use in step 308*a*. In another example, the output signal causes the indicator 66 to be illuminated in step 308*b* to inform the user that the upper frame must be lowered before the power drive system 18 can be used. In some contemplated embodiments, the indicator 66 can flash until the user lowers the upper frame 14 to a predetermined weighing height and then turn off to indicate the person support apparatus 10 is in a position where the power drive system 18 is ready for use.

Many other embodiments of the present disclosure are also envisioned. For example, a person support apparatus comprises a lower frame, an upper frame, a drive structure, and a control system. The upper frame is movably supported above the lower frame. The drive structure is coupled to the upper frame and configured to selectively engage a surface to, when activated, propel the person support apparatus along the surface. The control system is configured to determine an engagement status of the drive structure with the surface and trigger a response based on the engagement status.

In another example, a person support apparatus comprises a lower frame, an upper frame, a drive structure, and a control system. The upper frame is movably supported above the lower frame. The drive structure is coupled to the upper frame and configured to selectively engage a surface to, when activated, propel the person support apparatus along the surface. The control system is configured to determine an engagement status of the drive structure with the surface in response to a drive activation signal and trigger a response based on the engagement status.

In another example, a method, comprising the steps of: receiving an input signal indicative of the position of an upper frame of a person support apparatus with respect to a reference; determining an engagement status of a drive structure coupled to the upper frame of a person support apparatus as a function of the input signal; and if the engagement status is greater than a predetermined value, alerting a user as to the engagement status of the drive structure.

In another example, a method, comprising the steps of: receiving an input signal indicative of the position of an upper frame of a person support apparatus with respect to a reference; determining an engagement status of a drive structure coupled to the upper frame of a person support apparatus as a function of the input signal; and if the engagement status is less than a predetermined value, moving the upper frame to a predetermined position with respect to the reference.

In another example, a person support apparatus comprises a lower frame, a lift system coupled to the lower frame, an upper frame, an input, and a control system. The upper frame is movably supported above the lower frame by the lift system. The input is configured to receive a signal indicative of a user's desire to weigh a person supported on the person support apparatus. The control system is configured to determine the height of the upper frame with respect to a reference and, if the upper frame is less than a predetermined height, cause the lift system to raise the upper frame to a weighing height.

In another example, a person support apparatus comprises a lower frame, a lift system coupled to the lower frame, an upper frame, an input, and a control system. The upper frame is movably supported above the lower frame by the lift system. The input is configured to receive a signal indicative of a user's desire to weigh a person supported on the person support apparatus. The control system is configured to determine the height of the upper frame with respect to a reference and, if the upper frame is less than a predetermined height, alert a user that the upper frame must be raised.

In another example, a method of weighing a person on a person support apparatus, comprising the steps of: receiving a weighing signal from an input; determining the height of an upper frame of a person support apparatus with respect to a reference; and if the height is less than a predetermined height, cause a lift system to increase the height of the upper frame to a predetermined weighing height.

In another example, a person support apparatus comprises a lower frame, a lift system coupled to the lower frame, an upper frame, an input, and a control system. The upper frame is movably supported above the lower frame by the lift system. The input is configured to receive a signal indicative of a user's desire to weigh a person supported on the person support apparatus. The control system is configured to determine the position of the upper frame with respect to a reference and, if the upper frame is less than a predetermined distance above the reference, at least one of cause the lift system to raise the upper frame to a predetermined weighing position and alert a user that the upper frame must be raised.

In another example, a person support apparatus comprises a lower frame, a lift system coupled to the lower frame, an upper frame, a power drive system coupled to the upper frame, an input, and a control system. The upper frame is movably supported above the lower frame by the lift system. The power drive system is coupled to the upper frame and configured to selectively engage a surface to, when activated, propel the person support apparatus along the surface. The input is configured to receive a signal indicative of a user's desire to activate the power drive system. The control system is configured to determine the position of the upper frame with respect to a reference and, if the upper frame is greater than a predetermined distance above the reference, at least one of cause the lift system to lower the upper frame to a predetermined power drive system engagement position and alert a user that the upper frame must be lowered.

In another example, a person support apparatus comprises a lower frame, a lift system coupled to the lower frame, an upper frame, a power drive system, an input, and a control system. The upper frame is movably supported above the lower frame by the lift system. The power drive system is coupled to the upper frame and configured to selectively engage a surface to, when activated, propel the person support apparatus along the surface. The input is configured to receive a signal indicative of a user's desire to activate the power drive system. The control system is configured to determine the position of the upper frame with respect to a reference and, if the upper frame is less than a predetermined distance above the reference, alert a user that the upper frame must be lowered.

In another example, a method engaging a power drive system coupled to a person support apparatus with a surface, comprising the steps of: receiving a power drive activation signal from an input; determining the height of an upper frame of a person support apparatus with respect to a reference; and if the height is greater than a predetermined height, cause a lift system to at least one of decrease the height of the upper frame to a predetermined power drive engagement height and alert a user that the upper frame must be lowered.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described may be more desirable, it nonetheless may not be necessary and embodiments lacking the same may be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item may include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations may be apparent to those skilled in the art. Also, while multiple inventive aspects and principles may have been presented, they need not be utilized in combination, and various combinations of inventive aspects and principles are possible in light of the various embodiments provided above.

What is claimed is:

1. A person support apparatus, comprising:

a lower frame;

an upper frame movably supported above the lower frame by a lift system;

a weigh scale operable to weigh a person supported by the upper frame;

a drive structure coupled to the upper frame and movable with the upper frame as the upper frame is moved by the lift system with respect to the lower frame, the drive structure being configured to selectively engage a surface when the upper frame is in a lowered position to, when activated, propel the person support apparatus along the surface; and a control system configured to determine whether the drive structure engages the surface and trigger a response as a function of such determination, wherein the weigh scale is prevented by the control system from weighing the person if the drive structure is engaging the surface.

2. The person support apparatus of claim 1, wherein the response includes the control system causing the upper frame to move to a predetermined position with respect to the lower frame so that the drive structure engages the surface.

3. The person support apparatus of claim 1, wherein the response includes the control system communicating whether the drive structure engages the surface to a user.

4. The person support apparatus of claim 1, wherein the control system causes a light to be illuminated to indicate that the drive structure engages the surface.

5. The person support apparatus of claim 1, wherein the control system causes a light to be illuminated to indicate that the upper frame must be lowered.

6. The person support apparatus of claim 5, wherein the light flashes until the drive structure engages the surface.

7. The person support apparatus of claim 1, wherein the drive structure is movable with respect to the upper frame to maintain engagement of the drive structure with the surface as the drive structure moves along the surface, wherein the surface is a non-uniform surface.

8. The person support apparatus of claim 1, wherein the control system determines whether the drive structure engages the surface when the control system receives an input indicative of a user's desire to activate the drive structure.

9. The person support apparatus of claim 1, wherein the engagement of the drive structure with the surface is determined as a function of the position of the upper frame with respect to a reference.

10. The person support apparatus of claim 9, wherein the reference includes a surface of the lower frame.

11. The person support apparatus of claim 9, wherein the reference includes a floor surface.

12. The person support apparatus of claim 9, wherein the control system alerts a user that the drive structure system does not engage the surface when the distance between the upper frame and the reference exceeds a predetermined distance.

13. The person support apparatus of claim 12, wherein the predetermined distance includes the distance between the upper frame and the lower frame when the upper frame is in its lowest position with respect to the lower frame.

14. The person support apparatus of claim 9, wherein the control system includes a sensing element configured to sense the distance between the upper frame and the reference surface.

15. The person support apparatus of claim 14, wherein the sensing element includes a hall effect sensor.

16. The person support apparatus of claim 14, wherein the sensing element includes a limit switch.

17. The person support apparatus of claim 14, wherein the sensing element includes an ultrasonic sensing mechanism.

18. The person support apparatus of claim 1, wherein the response includes the control system causing the upper frame to move to a predetermined position with respect to the lower frame so that the drive structure is disengaged from the surface.

19. The person support apparatus of claim 1, wherein the response includes the control system communicating a status of the weigh scale to a user.

20. The person support apparatus of claim 1, wherein the response includes the control system causing a light to be illuminated to indicate that a person supported on the person support apparatus is able to be weighed when the drive structure is disengaged from the surface.

21. The person support apparatus of claim 1, wherein the response includes the control system causing a light to be illuminated to indicate that the upper frame must be raised.

22. The person support apparatus of claim 21, wherein the light flashes until the drive structure is disengaged from the surface.

23. The person support apparatus of claim 1, wherein the control system includes a limit switch that is in a first state when the drive structure engages the surface and is in a second state when the drive structure is disengaged from the surface.

24. The person support apparatus of claim 1, wherein the control system determines whether the drive structure engages the surface when the control system receives an input indicative of a user's desire to weigh a person.

25. The person support apparatus of claim 1, wherein the control system includes a sensor configured to sense when the drive structure engages the surface.

26. The person support apparatus of claim 1, wherein the drive structure is pivotably connected to the upper frame at a first joint and pivotably connected to the upper frame via a biasing element at a second joint, wherein the biasing element biases the drive structure toward engagement with the surface.

27. The person support apparatus of claim 26, wherein the control system includes a sensor coupled to the biasing element and configured to sense a characteristic of the biasing element indicative of whether the drive structure engages the surface.

* * * * *